United States Patent [19]

Chang

[11] Patent Number: 4,814,023

[45] Date of Patent: Mar. 21, 1989

[54] HIGH STRENGTH SUPERALLOY FOR HIGH TEMPERATURE APPLICATIONS

[75] Inventor: Keh-Minn Chang, Schenectady, N.Y.

[73] Assignee: General Electric Company, Schenectady, N.Y.

[21] Appl. No.: 52,513

[22] Filed: May 21, 1987

[51] Int. Cl.[4] ..... C22F 1/10

[52] U.S. Cl. ..... 148/2; 148/3; 148/11.5 N; 148/12.7 N; 148/162; 148/410; 148/428

[58] Field of Search ..... 420/448; 148/410, 428, 148/2, 3, 162, 11.5 N, 12.7 N

[56] References Cited

U.S. PATENT DOCUMENTS 4,685,977 8/1987 Chang ..... 148/410

*Primary Examiner*—R. Dean

*Attorney, Agent, or Firm*—Paul E. Rochford; James C. Davis, Jr.; James Magee, Jr.

[57] ABSTRACT

A novel alloy is provided having approximately the following ingredient formula:

| Element | Composition in weight % |
|---|---|
| Ni | balance |
| Cr | 10.0 |
| Co | 15.0 |
| Mo | 5.0 |
| W | 5.0 |
| Al | 3.5 |
| Ti | 3.0 |
| Ta | 7.2 |
| Zr | 0.03 |
| B | 0.03 |
| C | 0.03. |

The alloy has a solvus temperature of below 1200° C. Fatigue crack propagation rate is low for metal samples cooled at rates of 50° C./min to 200° C./min. The alloy has uniquely high strength at temperatures at and above 1200° F.

13 Claims, 3 Drawing Sheets

HIGH STRENGTH SUPERALLOY FOR HIGH TEMPERATURE APPLICATIONS

RELATED APPLICATIONS

The subject matter of this application relates generally to that of these commonly assigned, filed applications, the texts of which are hereby incorporated herein by reference as follows: Ser. No. 907,271; Ser. No. 907,550; Ser. No. 907,275; and Ser. No. 907,276; all of which were filed Sept. 15, 1986.

The subject application also relates generally to the subject matter of application Ser. No. 677,449, filed Dec. 3, 1984 which application is assigned to the same assignee as the subject application herein. The text of the related application is incorporated here by reference.

BACKGROUND OF THE INVENTION

It is well known that nickel based superalloys are extensively employed in high performance environments. Such alloys have been used extensively in jet engines and in gas turbines where they must retain high strength and other desirable physical properties at elevated temperatures of a 1000° F. or more.

Many of the nickel-based superalloys depend for part of their strength and other properties at high temperature on $\gamma'$ precipitates. Some detailed characteristics of the phase chemistry of $\gamma'$ are given in "Phase Chemistries in Precipitation-Strengthening Superalloy" by E. L. Hall, Y. M. Kouh and K. M. Chang, "Proceedings of 41st Annual Meeting of Electron Microscopy Society of America", August 1983 (p. 248).

The following U.S. patents disclose various nickel-base alloy compositions: U.S. Pat. Nos. 2,570,193; 2,621,122; 3,046,108; 3,061,426; 3,151,981; 3,166,412; 3,322,534; 3,343,950; 3,575,734; 3,576,681, 4,207,098 and 4,336,312. The aforementioned patents are representative of the many alloying situations reported to date in which many of the same elements are combined to achieve distinctly different functional relationships between the elements such that phases providing the alloy system with different physical and mechanical characteristics are formed. Nevertheless, despite the large amount of data available concerning the nickel-base alloys, it is still not possible for workers in the art to predict with any degree of accuracy the physical and mechanical properties that will be displayed by certain concentrations of known elements used in combination to form such alloys even though such combination may fall within broad, generalized teachings in the art, particularly when the alloys are processed using heat treatments different from those previously employed.

Most of the alloys that are processed either by cast and wrought or by powder metallurgy technologies can only retain their superior strength at temperatures up to about 1200° F. A dramatic drop in strength is observed when the temperature of these alloys is raised above 1200° F.

The objectives for nickel-base superalloys of this invention are to develop new alloy compositions which have high strength at temperatures above 1200° F. and which have minimum time dependence of fatigue cracking resistance, and extended stress rupture life.

Another object for nickel-base superalloys of this invention is the provision of an alloy system which is not sensitive to different cooling treatments but which may be subjected to a range of cooling treatments without significant deterioration or loss of desirable alloy properties and particularly high strength at high temperature.

A problem which has been recognized to a greater and greater degree with many such nickel based superalloys is that they are subject to formation of cracks or incipient cracks, either in fabrication or in use, and that the cracks can actually initiate or propagate or grow while under stress as during use of the alloys in such structures as gas turbines and jet engines. The propagation or enlargement of cracks can lead to part fracture or other failure. The consequence of the failure of the moving mechanical part due to crack formation and propagation is well understood. In jet engines it can be particularly hazardous and can be catastrophic.

However, what has been poorly understood until recent studies were conducted was that the formation and the propagation of cracks in structures formed of superalloys is not a monolithic phenomena in which all cracks are formed and propagated by the same mechanism and at the same rate and according to the same criteria. By contrast the complexity of the crack generation and propagation and of the crack phenomena generally and the independence of such propagation with the manner in which stress is applied is a subject on which important new information has been gathered in recent years. The period during which stress is applied to a member to develop or propagate a crack, the intensity of the stress applied, the rate of application and of removal of stress to and from the member and the schedule of this application was not well understood in the industry until a study was conducted under contract to the National Aeronautics and Space Administration. This study is reported to a technical report identified as NASA CR-165123 issued from the National Aeronautics and Space Administration in August 1980, identified as "Evaluation of the Cyclic Behavior of Aircraft Turbine Disk Alloys" Part II, Final Report, by B. A. Cowles, J. R. Warren and F. K. Hauke, and prepared for the National Aeronautics and Space Administration, NASA Lewis Research Center, Contract NAS3-21379.

A principal unique finding of the NASA sponsored study was that the rate of propagation based on fatigue phenomena or in other words the rate of fatigue crack propagation (FCP) was not uniform for all stresses applied nor to all manners of applications of stress. More importantly, the finding was that fatigue crack propagation actually varied with the frequency of the application of stress to the member where the stress was applied in a manner to enlarge the crack. More surprisingly still, was the finding from the NASA sponsored study that the application of stress of lower frequencies rather than at the higher frequencies previously employed in studies, actually increased the rate of crack propagation. In other words the NASA study revealed that there was a time dependence in fatigue crack propagation. Further the time dependence of fatigue crack propagation was found to depend not on frequency alone but on the time during which the member was held under stress for a so-called hold-time.

Following the discovery of this unusual and unexpected phenomena of increased fatigue crack propagation at lower stress frequencies there was some belief in the industry that this newly discovered phenomena represented an ultimate limitation on the ability of the nickel based superalloys to be employed in the stress bearing parts of the turbines and aircraft engines and that all design effort had to be made to design around this problem.

However, it has been discovered that it is feasible to construct parts of nickel based superalloys for use at high stress in turbines and aircraft engines with greatly reduced crack propagation rates.

The development of the superalloy compositions and methods of their processing of this invention focuses on the fatigue property and addresses in particular the time dependence of crack growth.

Crack growth, i.e., the crack propagation rate, in high-strength alloy bodies is known to depend upon the applied stress ($\sigma$) as well as the crack length (a). These two factors are combined by fracture mechanics to form one single crack growth driving force; namely, stress intensity K, which is proportional to $\sigma\sqrt{a}$. Under the fatigue condition, the stress intensity in a fatigue cycle represents the maximum variation of cyclic stress intensity ($\Delta K$), i.e., the difference between $K_{max}$ and $K_{min}$. At moderate temperatures, crack growth is determined primarily by the cyclic stress intensity ($\Delta K$) until the static fracture toughness $K_{IC}$ is reached. Crack growth rate is expressed mathematically as $da/dN \propto (\Delta K)^n$. N represents the number of cycles and n is a constant which is between 2 and 4.

At high temperatures, however, the cyclic frequency and the shape of the waveform become the important parameters determining the crack growth rate. For a given cyclic stress intensity, a slower cyclic frequency can result in a faster crack growth rate. This undesirable time-dependent behavior of fatigue crack propagation can occur in most existing high strength superalloys.

The most undesirable time-dependent crack-growth behavior has been found to occur when a hold time is superimposed on a sine wave variation in stress. In such case a test sample may be subjected to stress in a sine wave pattern but when the sample is at maximum stress the stress is held constant for a hold time. When the hold time is completed the sine wave application of stress is resumed. According to this hold time pattern the stress is held for a designated hold time each time the stress reaches a maximum in following the normal sine curve. This hold time pattern of application of stress is a separate criteria for studying crack growth. This type of hold time pattern was used in the NASA study referred to above.

Progress has been made in forming superalloy metal compositions containing high volume percents of strengthening precipitates and in processing of these metals into parts for advanced turbine engines and jet aircraft engines. This metal processing technology has been developed to introduce such superalloys into gas turbines and jet engines because of the higher temperature capabilities of the alloys themselves and because the engines built with such alloys also have higher temperature capabilities and resulting higher efficiencies and thrust per unit weight of engine. While some studies such as the NASA studies described above have been made of a number of these alloys, not all of the alloys have been examined comprehensively with respect to fatigue cracking and with respect to resistance to fatigue cracking.

It has been determined that at low temperatures the fatigue crack propagation depends essentially entirely on the intensity at which stress is applied to components and parts of such structures in a cyclic fashion. As is partially explained in the background statement above, the crack growth rate at elevated temperatures cannot be determined simply as a function of the applied cyclic stress intensity $\Delta K$. Rather the fatigue frequency can also affect the propagation rate. The NASA study demonstrated that the slower the cyclic frequency, the faster the crack grows per unit cycle of applied stress. It has also been observed that faster crack propagation occurs when a hold time is applied during the fatigue cycle. Time-dependence is a term which is applied to such cracking behavior at elevated temperatures where the fatigue frequency and hold time are significant parameters.

It is known that some of the most demanding sets of properties for superalloys are those which are needed in connection with jet engine construction. Of the sets of properties which are needed, those which are needed for the moving parts of the engine are usually greater than those needed for static parts although the sets of needed properties are different for the different components of an engine.

Because some sets of properties have not been attainable in cast alloy materials, resort is sometimes had to the preparation of parts by powder metallurgy techniques. However, one of the limitations which attends the use of powder metallurgy techniques in preparing moving parts for jet engines is that of the purity of the powder. If the powder contains impurities such as a speck of ceramic or oxide, the place where that speck occurs in the moving part becomes a latent weak spot where a crack may initiate or a latent crack.

As alloy products for use in turbines and jet engines have developed, it has become apparent that different sets of properties are needed for parts which are employed in different parts of the engine or turbine. For jet engines, the material requirements of more advanced aircraft engines continue to become more strict as the performance requirements of the aircraft engines are increased. The different requirements are evidenced, for example, by the fact that many blade alloys display very good high temperature properties in the cast form. However, the direct conversion of cast blade alloys into disk alloys is very unlikely because blade alloys display inadequate strength at intermediate temperatures of about 700° C. Further, the blade alloys have been found very difficult to forge and forging has been found desirable in the fabrication of blade from disk alloys. Moreover, the crack growth resistance of disk alloys has not been evaluated.

Accordingly, to achieve increased engine efficiency and greater performance, constant demands are made for improvements in the strength and temperature capability of disk alloys as a special group of alloys for use in aircraft engines. Now these capabilities must be coupled with low fatigue crack propagation rates and a low order of time-dependency of such rates.

What was sought in undertaking the work which led to the present invention was the development of a disk alloy which had superior strength at temperatures above 1200° F. and which had a lower or minimum time dependence of fatigue crack propagation and moreover a high resistance to fatigue cracking. Further, what was sought, was high strength and long stress rupture life.

A main objective was to provide a composition which has high strength at temperatures above 1200° F. together with a high resistance to time dependent fatigue crack propagation. One way in which this objective is achieved is through extending the cooling rate for preparation of the composition. One thing that is highly desirable in the composition of this invention is that it permits a broad range of variation in the cooling rate but still provides the desired combination of strength at high temperature together with resistance to time dependent fatigue crack propagation. In other words this is a unique alloy because it not only has high temperature strength coupled with time dependent fatigue crack propagation resistant properties but these properties are achieved and can be achieved over a broad range of cooling rates.

In addition the accomplishment of the high strength capability coupled with time dependent fatigue crack propagation resistance at this broad range of cooling rates does not detract from other properties of the alloy as the alloy itself does have a good combination of strength and rupture life. Also this exceptional combination of high temperature strength and other properties is achieved at cooling rates over any part of a broad range where such cooling is responsible for the resulting properties of the time dependent fatigue crack propagation resistant alloy. In other words there is no significant loss of higher temperature strength or rupture life properties over this whole cooling rate range. The alloy which is prepared according to the present invention not only has the good resistance to fatigue crack propagation but it has good high temperature strength at temperatures above 1200° F. and good rupture life.

BRIEF DESCRIPTION OF THE INVENTION

It is, accordingly, one object of the present invention to provide nickel-base superalloy products which have high strength at high temperature and are more resistant to cracking.

Another object is to provide a method and composition for reducing the tendency of nickel-base superalloys capable of use at temperatures above 1200° F. to undergo cracking.

Another object is to provide articles fo use under cyclic high stress which have good strength above 1200° F. and are more resistant to fatigue crack propagation.

Another object is to provide a composition and method which permits nickel-base superalloys to have imparted thereto high strength above 1200° F. and resistance to cracking under stress which is applied cyclically over a range of frequencies.

Other objects will be in part apparent and in part pointed out in the description which follows.

In one of its broader aspects, objects of the invention can be achieved by providing a composition of the following approximate content:

| | Composition in weight % | |
|---|---|---|
| Element | Nominal | Range |
| Ni | bal. | bal. |
| Cr | 10 | 8–12 |
| Co | 15 | 13–18 |
| Mo | 5 | 3–6 |
| W | 5 | 3–6 |
| Al | 3.5 | 3–4 |
| Ti | 3.0 | 2–4 |
| Ta | 7.2 | 6–9 |
| Zr | 0.03 | 0.001–0.05 |
| B | 0.03 | 0.001–0.05 |
| C | 0.03 | 0.01–0.05 |

The nominal composition is the composition containing percentages of ingredients by weight which were specified and sought in preparing compositions as set out in the Examples below.

The range of compositions set forth the percentage of ingredients which are deemed to provide the novel sets of properties which are more fully described below.

In respect to nickel the term "balance essentially" is used to include, in addition to nickel in the balance of the alloy, small amounts of impurities and incidental elements, which in character and/or amount do not adversely affect the advantageous aspects of the alloy.

In preparing the alloy, the steps which may be employed include melting the composition to form a melt, atomizing the melt by gas atomization, consolidating the powder by hot isostatic pressing and forging. The forged specimens may then be solution annealed at 1200° C. for 1 hour to provide a supersolvus anneal followed by cooling at a selected cooling rate. The samples may then be given an isothermal anneal at about 760° C. for about 16 hours, followed by cooling the alloy.

BRIEF DESCRIPTION OF THE DRAWINGS

In the description which follows clarity of understanding will be gained by reference to the accompanying drawings in which.

DETAILED DESCRIPTION OF THE INVENTION

Figure 1:
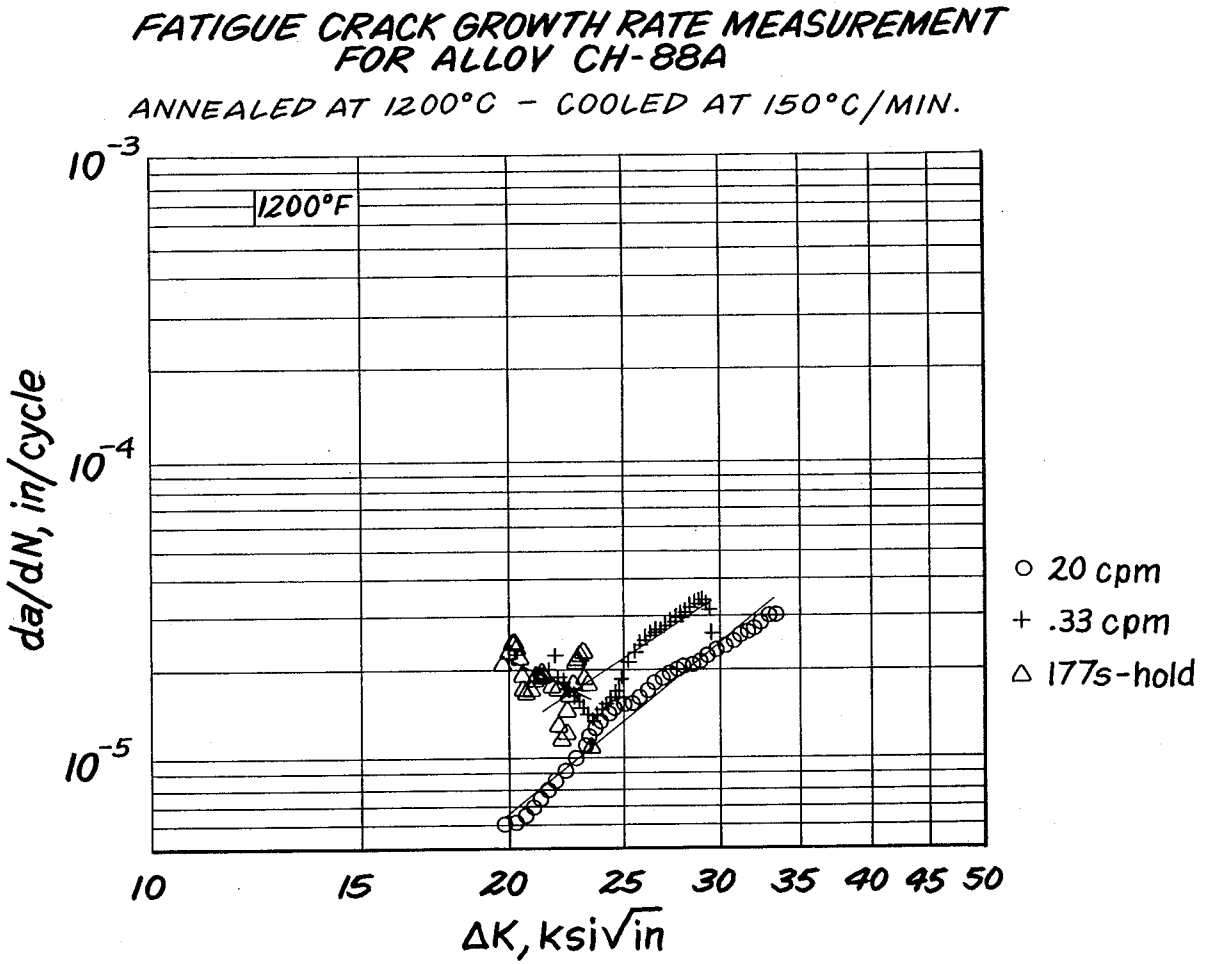
FIGS. 1 and 2 are graphic (log-log plot) representations of fatigue crack growth rates (da/dN) obtained at 1200° F. at various stress intensities ($\Delta K$) for the same alloy, after different cooling rates from elevated supersolvus solution annealing temperatures, under cyclic stress applications at a series of frequencies one of which cyclic stress applications includes a hold time at maximum stress intensity.

Pursuant to the present invention a superalloy which has excellent high strength at high temperature is provided. The superalloy of the invention can be prepared by casting and the cast alloy can be wrought. Further the superalloy of the invention can be prepared by advanced metal processing procedures such as powder metallurgy procedures and spray forming procedures such as by the commercially known Osprey process. The superalloy prepared by such advanced processing procedures can also be effectively wrought or forged.

The present invention also encompasses a method for processing the superalloy to produce material with a superior set or combination of properties for use in advanced engine disk applications.

The properties which are conventionally needed for materials used in disk applications include high tensile strength and high stress rupture strength. In addition the alloy of the subject invention exhibits a desirable property of resisting crack growth propagation. Such ability to resist crack growth is essential for the component low cycle fatigue life or LCF.

In addition to this superior set of properties as outlined above, the alloy of the present invention displays good tensile strength at high temperatures as for example above 1200° F.

EXAMPLE 1

An alloy powder was prepared by vacuum melting and gas atomization. The alloy was first melted by vacuum induction melting and was then gas atomized using argon as the atomizing gas.

The ingredient content of the alloy was prescribed according to the following composition:

TABLE I

| MONIMAL COMPOSITION OF CH-88A | | |
|---|---|---|
| | wt. % | at. % |
| Ni | bal. | bal. |
| Co | 15.0 | 15.56 |
| Cr | 10.0 | 11.75 |
| Mo | 5.0 | 3.19 |
| W | 5.0 | 1.66 |
| Al | 3.5 | 7.93 |
| Ti | 3.0 | 3.83 |
| Ta | 7.2 | 2.43 |
| Zr | 0.03 | 0.02 |
| B | 0.03 | 0.17 |
| C | 0.03 | 0.15 |

The alloy of Table I is a superalloy which forms a strengthening $\gamma'$ precipitate. The alloy was designated alloy CH-88A.

I have found that the alloy of the composition as set forth in Table I has a novel high strength at high temperature as is explained more fully below.

A master heat having a composition as set forth in Table I was prepared by vacuum induction melting as described above to form an 18 lb. ingot. Powder atomization was performed in a gas atomizer using argon gas. Screened powder of −140 mesh were collected. The collected powder was placed in a metal can as conventionally used for hot isostatic pressing and the can was evacuated and sealed.

The sealed can was HIPped at 1175° C. (2147° F.) at 15 ksi (103 MPa) for four hours. The as-HIPped can had a rectanguloid form and dimensions of 1.5 inches by 3.0 inches by 4.0 inches.

The as-HIPped can was hot pressed several times at 1150° C., the last pressing of which reduced one dimension by 37.5%.

The specimen which had been forged was cut into smaller specimens designated as blanks and the blanks were subjected to controlled heat treatments including a cooling at a controlled rate.

The precipitate solvus of the sample was determined by metallographic technique to be 1185° C.

Solution annealing was carried out at 1200° C. for one hour for all the blanks followed by cooling at two different rates. Half the solution annealed samples were cooled at 150° C./min. and the other half were cooled at 75° C./min. The cooling at 150° C./min. was accomplished by chamber cooling. The cooling at 75° C./min was accomplished by steel-can cooling.

After the solution treatment and cooling the alloy specimens received a single aging treatment at 760° C. for 16 hours (1400° F./16 hours).

Standard round tensile bars of 0.10 in. gauge diameter were machined and low-stress ground for tensile testing.

The tensile properties as functions of the testing temperature are shown in Table 2. Alloy CH-88A exhibits good strength at 1200° F. and also at 1400° F. Both tensile and yield strength start to decrease above 1400° F. Samples of the two materials CH-88A and Rene' 95 which had been solution annealed and cooled at the rate indicated in Table 2 were tested at the two temperatures 1200° F. and 1400° F. Test results are given in Table 2 below.

TABLE 2

| | High Temperature Tensile Properties | | | |
|---|---|---|---|---|
| Alloy | Cooling Rate (C/min) | Test Temp (F.) | Yield Strength (ksi) | Tensile Strength (ksi) |
| CH-88A | 150 | 1200 | 173 | 240 |
| | | 1400 | 169 | 203 |
| CH-88A | 75 | 1200 | 164 | 234 |
| | | 1400 | 157 | 192 |
| Rene' 95 | 150 | 1200 | 158 | 223 |
| | | 1400 | 152 | 173 |
| Rene' 95 | 75 | 1200 | 152 | 215 |
| | | 1400 | 146 | 165 |

It was observed that a slow cooling rate results in a lower strength at both testing temperatures and for both alloys but that the CH-88A sample retained good strength at 1400° F. even where the slower cooling rate was employed.

Rene' 95 is a conventional superalloy which is known to have high strength properties. It is evident from the data of Table 2 that the CH-88A alloy of this invention has high temperature strength properties which are superior to those of the Rene' 95 alloy both at 1200° F. and at 1400° F.

Fatigue crack propagation (FCP) tests were performed by employing a single-edge notched (SEN) specimen and a dc electric potential drop technique. Different cyclic waveforms, as described above with reference to the NASA study, were employed in the testing.

Figure 2:
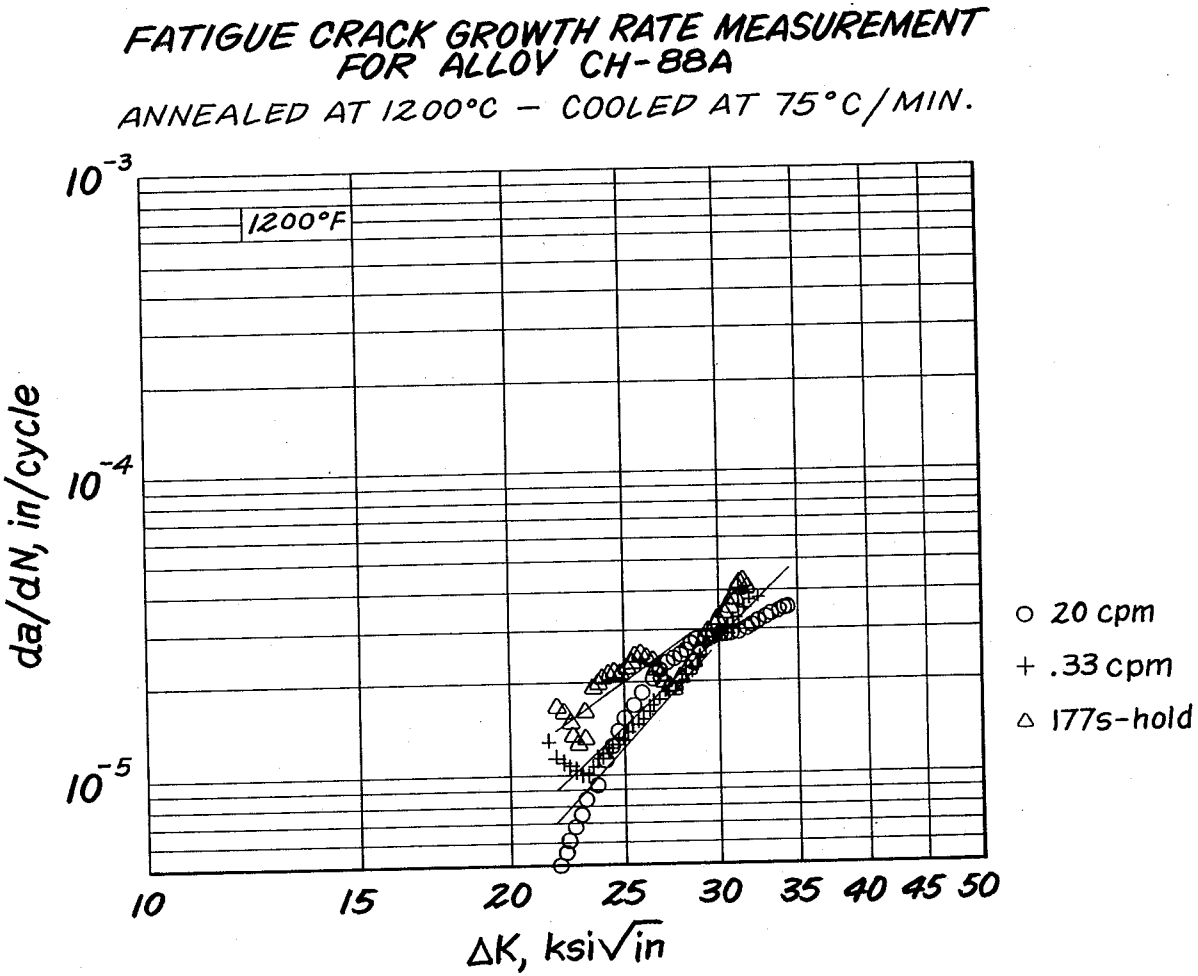

The cycles included standard 20 cycles per minute (cpm) sinusoidal cycle (3 second per cycle); 60 times slower at 0.33 cpm sinusoidal cycle (180 second per cycle); and 20 cpm sinusoidal cycle with a 177 second hold at peak load (180 second per cycle). The minimum to maximum load ratio R was kept at 0.05 in all waveforms. The da/dN curves for alloy CH-88A alloy samples are plotted in FIGS. 1 and 2. The CH-88A alloy displays no time dependence of this crack growth rate even for the fast cooling rate of 150° C. per minute after a supersolvus anneal.

Figure 3:
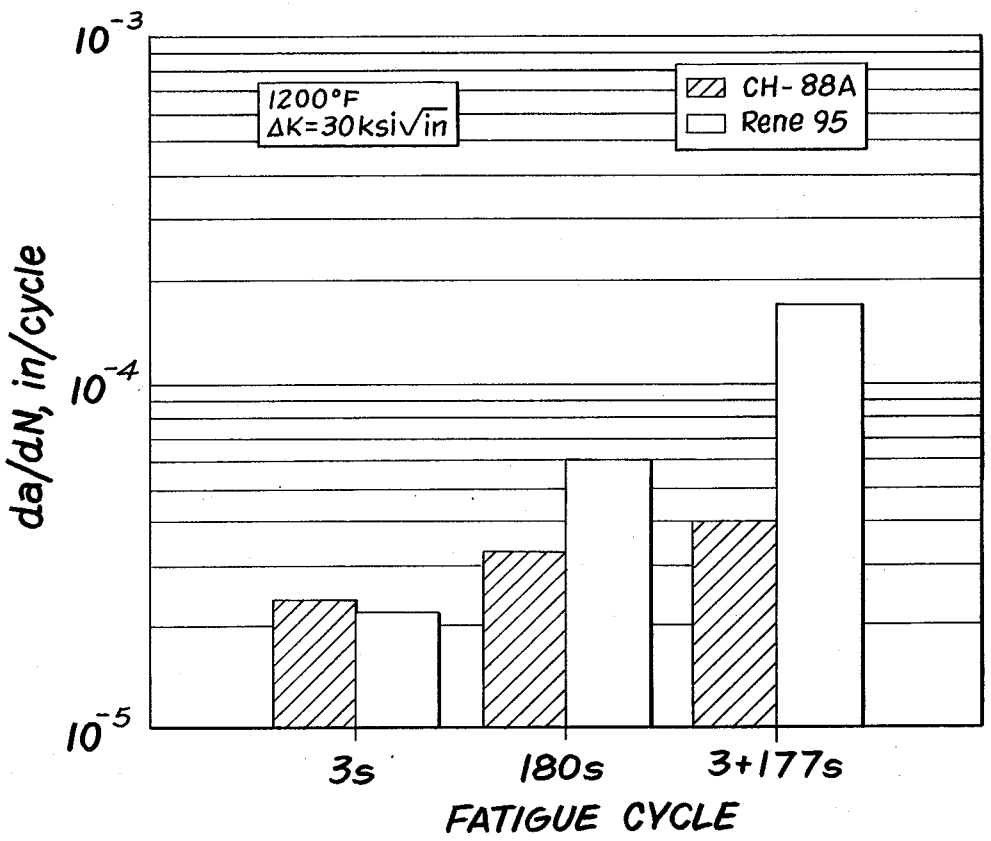
FIGS. 3 is a bar graph in which fatigue crack propagation rate is plotted on a comparative basis for the three different cycles which were studied.

To provide a basis for comparison of crack growth rate of the CH-88A alloy relative to a conventional alloy data is plotted in FIG. 3 to display their comparative similarities and differences. The comparative data plotted is for a crack growth rate of $\Delta K = 30$ ksi$\sqrt{\text{in.}}$ This data was obtained after both the CH-88A alloy and the Rene' 95 had undergone a supersolvus anneal and had been cooled at the same cooling rate.

What is noteworthy about the alloy of the present invention is that it can be subjected to a range of cooling rates extending from 75° C./min to 150° C./min without very substantial change in the resultant strength of the alloy.

Measurements were also made of the relative strengths of each of the samples prepared, as indicated above, and the relationship or the function of the cooling rate relative to the strength is listed in Table 2. It is evident from Table 2 that generally the higher cooling rates favor higher tensile strength and yield strength. However, the tensile and yield strength achieved at the lower heating rate is still very substantial. As indicated in the table, the heating of the tensile and yield strengths were measured at 1200° F. and at 1400° F. For comparison, similar measurements were made with samples of Rene' 95 which were also supersolvus annealed and cooled at different rates. Rene' 95 is known to be the strongest commercially available superalloy. The alloy of the present invention has an advantage of 150° to 200° F. over the strengths measured for the Rene' 95 alloy sample.

What is claimed and sought to be protected by Letters Patent of the United States is as follows:

1. A nickel base superalloy composition consisting essentially of the following composition

| Element | Composition in weight % From | To |
|---|---|---|
| Ni | balance | |
| Cr | 8 | 12 |
| Co | 13 | 18 |
| Mo | 3 | 6 |
| W | 3 | 6 |
| Al | 3 | 4 |
| Ti | 2 | 4 |
| Ta | 6 | 9 |
| Zr | 0.01 | 0.05 |
| B | 0.01 | 0.05 |
| C | 0.01 | 0.05 |

and which has been supersolvus annealed and cooled at a rate of less than 250° C./min.

2. The alloy of claim 1 which has a low fatigue crack propagation rate, which has been supersolvus annealed and which has been cooled at a rate between 20° C./min and 200° C./min.

3. The alloy of claim 1 in which the tensile strength is above 190 ksi at temperatures of 1200° F. to 1400° F.

4. The alloy of claim 1 in which the solvous temperature is below 1200° C.

5. The alloy of claim 1 in which the composition is as follows:

| Element | Composition in weight % |
|---|---|
| Ni | balance |
| Cr | 10.0 |
| Co | 15.0 |
| Mo | 5.0 |
| W | 5.0 |
| Al | 3.5 |
| Ti | 7.2 |
| Ta | 0.03 |
| Zr | 0.03 |
| B | 0.03 |
| C | 0.03 |

6. The method of preparing a nickel base superalloy which comprises preparing a melt consisting essentially of the following approximate ingredient content:

| Element | Composition in weight % From | To |
|---|---|---|
| Ni | balance | |
| Cr | 8 | 12 |
| Co | 13 | 18 |
| Mo | 3 | 6 |
| W | 3 | 6 |
| Al | 3 | 4 |
| Ti | 2 | 4 |
| Ta | 6 | 9 |
| Zr | 0.01 | 0.05 |
| B | 0.01 | 0.05 |
| C | 0.01 | 0.05 |

cooling the melt to a solid, supersolvus annealing the solid, and cooling the solid at a rate of 250° C./min. or less.

7. The method of claim 6 in which the cooling rate is between 50° C./min and 200° C./min.

8. The method of claim 6 in which the solid is subjected to heat aging following the cooling.

9. The method of claim 6 in which the solid is subjected to heat aging at about 760° C. for about 16 hours.

10. The method of claim 6 in which the composition is as follows:

| Element | Composition in weight % |
|---|---|
| Ni | balance |
| Cr | 10.0 |
| Co | 15.0 |
| Mo | 5.0 |
| W | 5.0 |
| Al | 3.5 |
| Ti | 3.0 |
| Ta | 7.2 |
| Zr | 0.03 |
| B | 0.03 |
| C | 0.03. |

11. The method of claim 6 in which the alloy is forged after cooling from the melt.

12. The method of claim 6 in which the cooling of the melt to a solid is by powder atomization.

13. The method of claim 6 in which the cooling of the melt to a solid is by spray forming.

* * * * *